United States Patent [19]

Christopher et al.

[11] 4,116,130

[45] Sep. 26, 1978

[54] METHODS AND APPARATUS FOR SEVERING TUBULAR MEMBERS

[75] Inventors: Glenn B. Christopher; John A. Regalbuto, both of Fort Worth, Tex.

[73] Assignee: Jet Research Center, Inc., Arlington, Tex.

[21] Appl. No.: 784,096

[22] Filed: Apr. 4, 1977

[51] Int. Cl.[2] ..... E21B 29/02

[52] U.S. Cl. ..... 102/20; 102/24 HC; 175/4.52; 175/4.6

[58] Field of Search ..... 175/4.52, 4.53, 4.6; 102/20, 21.8, 24 HC; 89/1 C

[56] References Cited

U.S. PATENT DOCUMENTS

| | | | |
|---|---|---|---|
| 2,543,814 | 3/1951 | Thompson et al. | 102/20 X |
| 2,690,123 | 9/1954 | Kanady | 89/1 C |
| 2,737,115 | 3/1956 | Bissell | 89/1 C |
| 2,761,384 | 9/1956 | Sweetman | 102/24 HC |
| 3,031,964 | 5/1962 | Chesnut | 102/24 HC |
| 3,415,321 | 12/1968 | Venghiattis | 175/4.6 |

*Primary Examiner*—Verlin R. Pendegrass
*Attorney, Agent, or Firm*—Thomas R. Weaver; J. H. Tregoning; C. Clark Dougherty, Jr.

[57] ABSTRACT

Methods and apparatus for severing tubular members whereby one or more shaped charges are positioned adjacent the interior walls of the tubular members and detonated to thereby sever the tubular members. The apparatus of the invention is adapted to be placed within a tubular member and includes a remotely extendible framework having remotely detonatable shaped charges attached thereto. The apparatus is of a size such that when the framework is not extended, the apparatus passes through constrictions contained within the tubular members, and when extended, the framework is positioned transversely to the axis of the tubular member with the shaped charges positioned adjacent the interior walls thereof.

20 Claims, 13 Drawing Figures

METHODS AND APPARATUS FOR SEVERING TUBULAR MEMBERS

In industry, requirements involving the severing of tubular members at points inaccessible from the outsides of the members often arise. For example, in the oil industry, it is sometimes desirable or required that casing disposed in a well bore be severed at a point below ground level. Also, in offshore drilling operations, vertically positioned casing and other lengths of pipe must often be severed below the level of the body of water in which the operations are carried out. Generally, such tubular members include portions of smaller effective internal diameter than other portions thereof, such as constrictions caused by connectors which connect sections of the tubular members together.

In forming pilings beneath a body of water such as the pilings required for the installation of offshore production platforms, tubular members are commonly utilized which extend from the surface of the body of water to the earth's surface lying below the body of water. Such elongated tubular members are generally comprised of short sections of pipe connected together by special load-bearing connectors which form internal constrictions within the interior of the length of pipe. After a piling has been formed beneath the body of water, it is desirable that the pipe used to form the piling and the connectors associated therewith be recovered which involves severing the pipe at a point adjacent the bottom of the body of water.

Shaped charges have heretofore been utilized for severing structural members and the like. Linear shaped charges are particularly well suited for such applications and are comprised of elongated masses of explosive material having V-shaped cross-sections. Upon detonation of such linear shaped charges, because of the V-shape of the explosive material, a substantially unidirectional explosive jet is produced capable of deep penetration. However, it is essential that an air space exist between the shaped charge and the target to be severed in that the jet produced must travel a distance before meeting incompressible liquids or other obstructions in order to achieve proper penetration of the target. The length of the air space required between the shaped charge and the target to achieve proper penetration of the target is known in the art as the "stand-off" distance.

Attempts to utilize shaped charges for severing tubular members from the inside thereof, particularly tubular members having constrictions therein, have generally been unsuccessful due to the problems involved in passing the shaped charges or a tool having one or more shaped charges attached thereto through the tubular members and obtaining the required stand-off between the walls of the tubular members and the shaped charges. Further, in applications where water, oil or other fluids are contained within the tubular member to be severed, the presence of such fluids between the shaped charges and the walls of the tubular member interferes with the formation of explosive jets of required penetration ability.

By the present invention, methods and apparatus for severing tubular members including tubular members having internal constrictions therein at points below or beyond the constrictions are provided whereby shaped charges are positioned within the tubular members and the required stand-off is obtained even though the tubular members contain fluids such as oil or water.

The method of the present invention for severing a tubular member having at least one internal constriction therein at a point below or beyond the constriction comprises placing a tool within the interior of the tubular member at the point below or beyond the constriction where it is desired to sever the member. The tool of the invention includes a remotely extendible framework having one or more remotely detonatable shaped charges attached thereto and is of a size such that when the framework is not extended, the tool passes through the constriction, and when extended, the framework is positioned transversely to the axis of the tubular member with the shaped charges positioned and centered adjacent the interior walls of the member. The framework is extended after the tool has been placed within the tubular member and passed through the constriction so that the shaped charges are positioned with the proper stand-off at the point where it is desired to sever the member and the shaped charges are detonated to thereby sever the member.

In the drawings forming a part of this disclosure:

Figure 1:
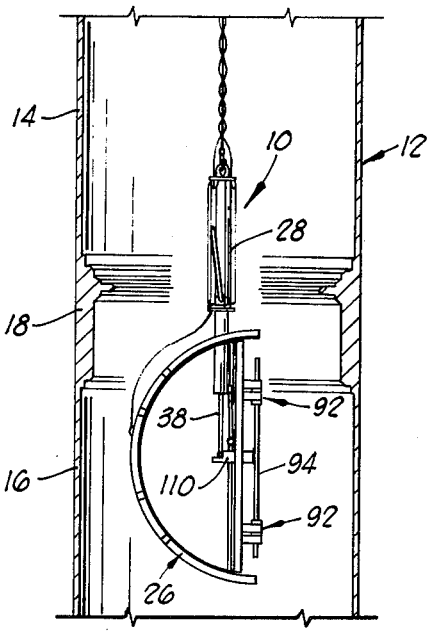
FIG. 1 is a side sectional view of an elongated tubular member including a constriction therein with the apparatus of the present invention shown in a non-extended position as it is being lowered within the tubular member through the constriction.
Figure 2:
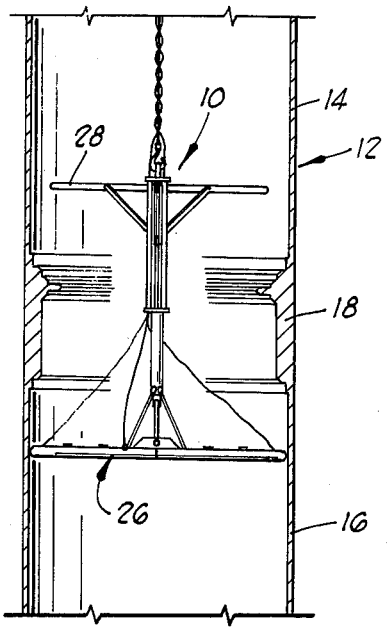
FIG. 2 is a side sectional view of the tubular member of FIG. 1 illustrating the apparatus of the present invention in the extended position.

Referring now to the drawings and particularly to FIGS. 1 and 2, the apparatus of the present invention is generally designated by the numeral 10 and is illustrated as it is being lowered through an elongated tubular member 12. The tubular member 12 is typical of oil well casings or the elongated tubular members utilized for forming pilings under water and includes at least two pipe sections 14 and 16 connected together by a connector 18. The connector 18 can take a variety of forms, but often in offshore drilling operations and piling forming operations includes inwardly extending structure for supporting one or more internal strings of pipe forming a constriction within the length of pipe 12. When it is desired to sever the length of pipe 12 at a point inaccessible from the outside of the pipe, the apparatus 10 is lowered through the interior of the length of pipe 12 and through constrictions contained therein by means of a cable or equivalent means connected thereto. While the tubular member 12 is shown positioned vertically in the drawings and the apparatus 10 is shown and described as being lowered within the interior of the tubular member 12 by means of a cable or equivalent means, it will be understood that the apparatus can be placed within and utilized to sever tubular members positioned vertically, horizontally or obliquely.

As shown in FIGS. 1 and 2, and as will be described in detail hereinbelow, the apparatus 10 includes a remotely extendible framework 26 having shaped charges attached thereto and is of a size such that when the framework 26 is not extended, the apparatus 10 readily passes through the interior of the length of the pipe 12 and constrictions therein. When the apparatus 10 is lowered to the location where it is desired to sever the length of pipe 12, the framework 26 is extended so that it is positioned transversely to the axis of the length of pipe 12 and so that the peripheral portions of the framework and shaped charges are positioned adjacent the interior walls of the length of pipe 12. The apparatus 10 also includes a plurality of extendible centering members 28 which are maintained in a folded position while the apparatus 10 is being lowered as shown in FIG. 1, and which are extended simultaneously with the framework 26 to facilitate centering the apparatus 10 within the length of pipe 12 as shown in FIG. 2.

Figure 8:
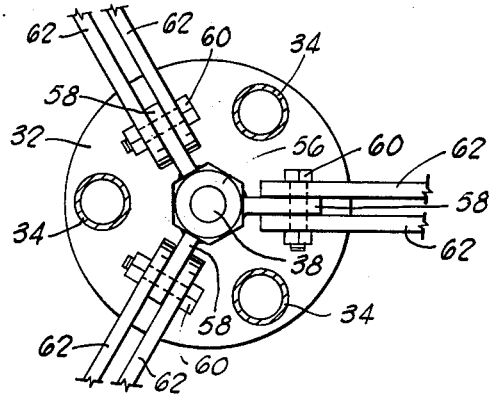
FIG. 8 is a cross-sectional view taken along line 8—8 of FIG. 3.
Figure 3:
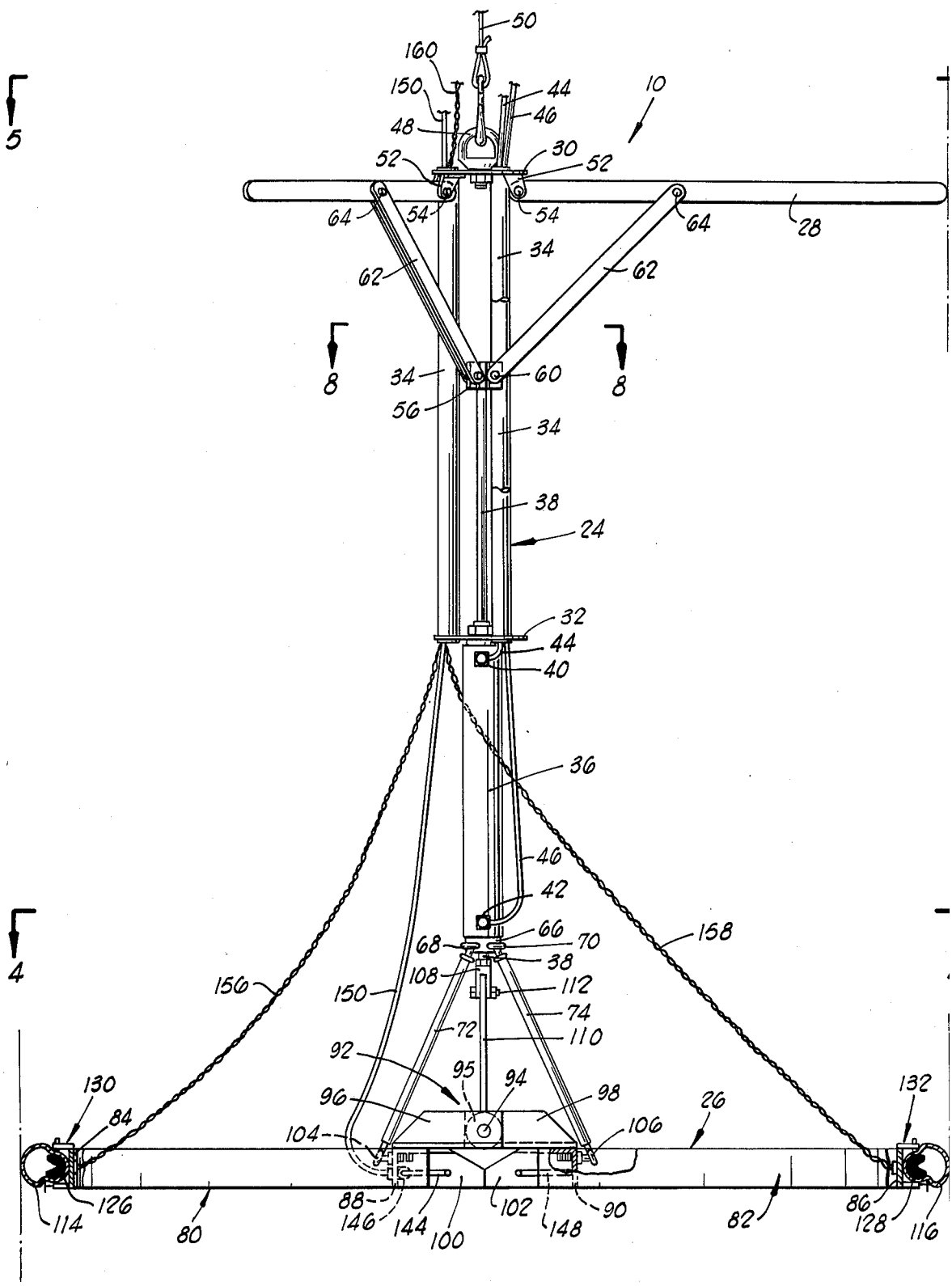
FIG. 3 is an enlarged partly sectional side elevational view of the apparatus of the present invention in the extended position.
Figure 5:
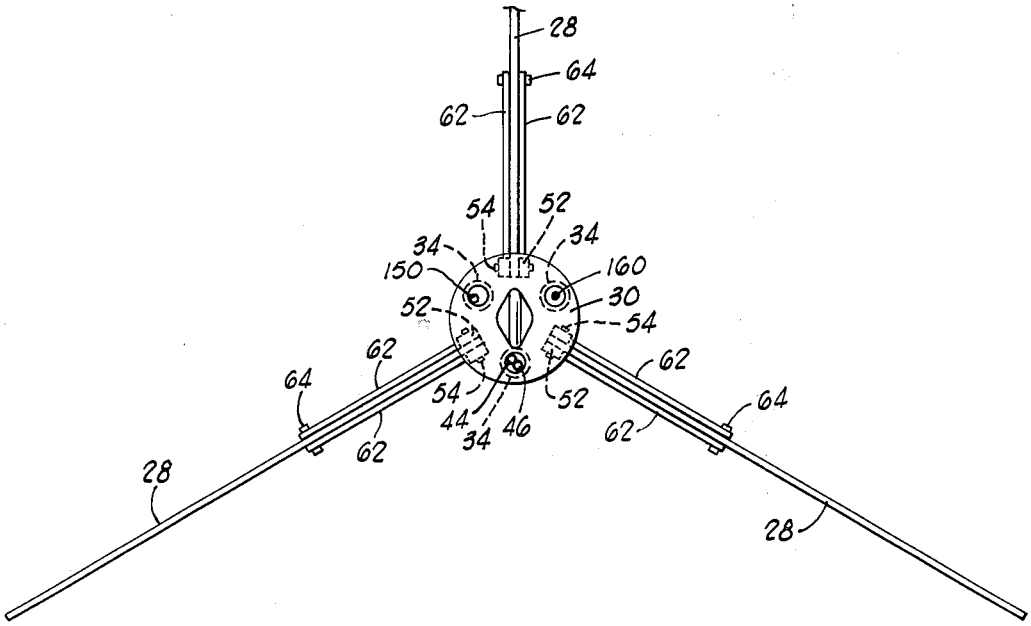
FIG. 5 is a top view taken along line 5—5 of FIG. 3.

Referring now to FIG. 3, the apparatus 10 is comprised of a frame generally designated by the numeral 24 having a foldable framework generally designated by the numeral 26 pivotally attached to the lower end thereof and a plurality of centering members 28 pivotally attached to the upper end thereof. The frame 24 is formed of an upper circular plate 30 rigidly connected to a lower circular plate 32 by three elongated tubular members 34. As best shown in FIGS. 5 and 8, the tubular members 34 are connected to the plates 30 and 32 in spaced relationship adjacent the peripheries of the plates 30 and 32.

Connected to the center of the plate 32 and extending downwardly therefrom is a pneumatically operated power cylinder 36 having a shaft 38 extending above the plate 32 and below the cylinder 36. As will be understood by those skilled in the art, the pneumatic cylinder 36 includes a movable piston disposed therein (not shown) which is rigidly connected to the shaft 38. Air connections 40 and 42 are attached to the cylinder 36 at the upper and lower ends respectively, and a pair of air hoses 44 and 46 are connected to the connections 40 and 42 respectively. The air hoses 44 and 46 are conveniently passed through the interior of one of the elongated tubes 34 to the upper end of the frame 24. A ring or eye 48 is connected to the plate 30 which is in turn connected to a cable 50 for lowering the apparatus within the interior of a tubular member to be severed.

As best shown in FIGS. 3 and 5, the interior ends of the centering members 28 are pivotally attached to the plate 30 by means of lugs 52 rigidly attached to the underside of the plate 30. While any desired number of centering members 28 can be utilized, preferably three centering members 28 are pivotally attached to three pairs of lugs 52 by bolts or pins 54 with the lugs 52 and centering members 28 being positioned in spaced relationship around the plate 30.

As best shown in FIGS. 3 and 8, a connecting member 56 which includes three lugs 58 is rigidly attached to the upper end of the shaft 38. A pair of lever arms 62 is pivotally attached to each of the lugs 58 by means of a bolt or pin 60 and each pair of lever arms 62 is pivotally attached to one of the centering members 28 at a point intermediate the ends thereof by a bolt or pin 64. As will be described in greater detail hereinbelow, as the shaft 38 and the connecting member 56 attached to the upper end thereof move upwardly and downwardly, the lever arms 62 cause the centering members 28 to be moved between the extended position shown in FIGS. 2 and 3 and the folded position shown in FIG. 1.

Figure 6:
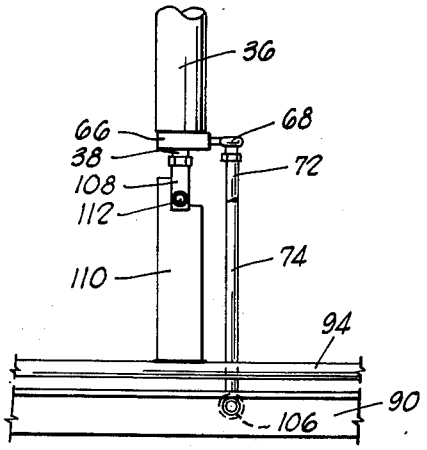
FIG. 6 is a cross-sectional view taken along line 6—6 of FIG. 4.
Figure 4:
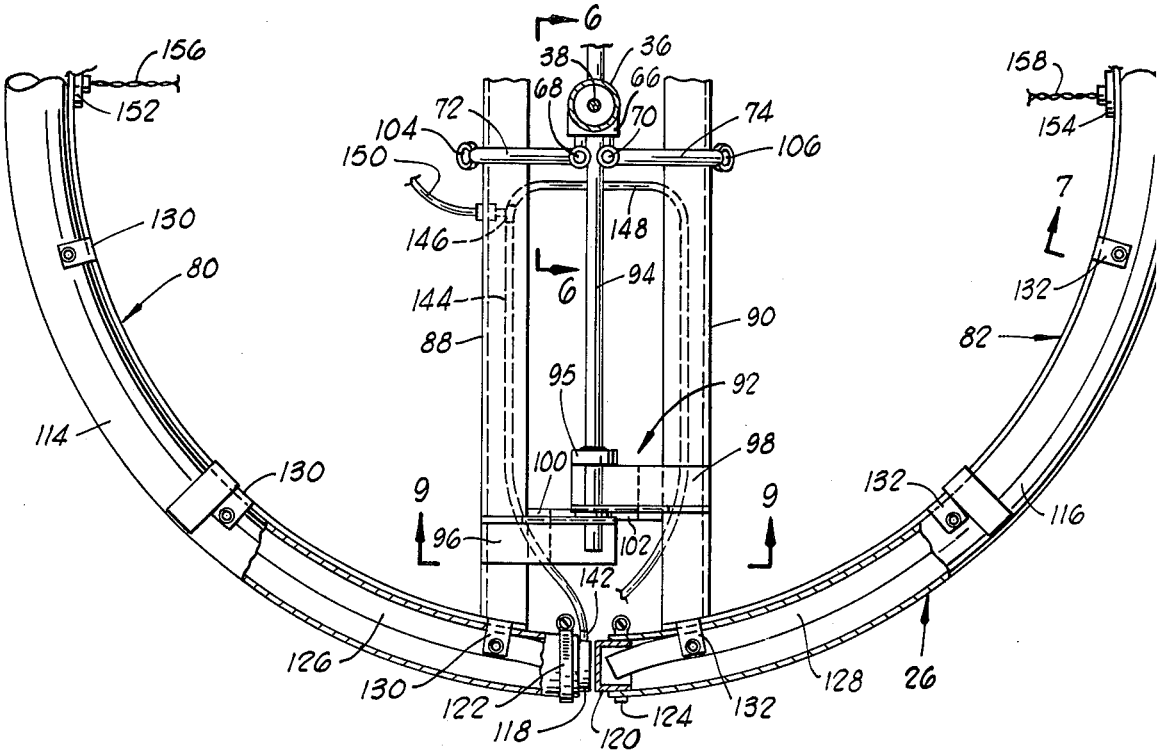
FIG. 4 is a cross-sectional view taken along line 4—4 of FIG. 3.

As best shown in FIGS. 3, 4 and 6, a member 66 is rigidly attached to the lower end of the pneumatic cylinder 36 having a pair of pivotable ball and joint fittings 68 and 70 attached thereto. The fitting 68 is connected to the upper end of an elongated arm member 72 and the fitting 70 is connected to the upper end of a second arm member 74 identical to the arm member 72. The lower ends of the arm members 72 and 74 are pivotally connected to the framework 26.

Figure 9:
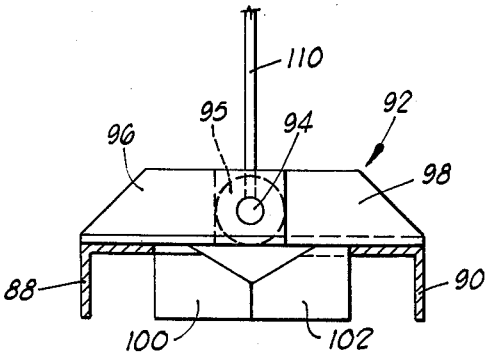
FIG. 9 is a cross-sectional view taken along line 9—9 of FIG. 4.

Referring now to FIGS. 3 and 4, the framework 26 is circular in shape and is comprised of a pair of identical hinged-together semicircular parts generally designated by the numerals 80 and 82. Each of the parts 80 and 82 include elongated semicircular bars 84 and 86, respectively, connected at points adjacent the ends thereof by angle members 88 and 90, respectively. The angles 88 and 90 are positioned parallel to each other and are offset equal distances from the ends of the bars 84 and 86. As shown best in FIGS. 1 and 10 through 13, a pair of spaced apart hinge assemblies, generally designated by the numeral 92, are attached to the angles 88 and 90 which pivot on a shaft 94 positioned on a line coinciding with the diameter of the framework 26 along which the parts 80 and 82 fold. More specifically, and referring particularly to FIGS. 3, 4 and 9, each of the hinge assemblies 92 includes a pair of angle members 96 and 98 rigidly attached at the outer ends thereof to the angle members 88 and 90, respectively. The angles 96 and 98 are positioned transversely to the axes of the angles 88 and 90 and are located thereon so that the inner ends of the angles 96 and 98 lie adjacent each other. That is, the angles 96 and 98 are of lengths such that the inner upstanding ends thereof overlap. Opposite ends of the shaft 94 pass through complementary openings in the angles 96 and 98 of the hinge assemblies 92 so that the members 96 and 98 pivot on the shaft 94. A pair of flanges 95 are rigidly attached to the shaft 94 for maintaining the shaft 94 in place. The angle members 96 and 98 of the hinge assemblies 94 further include stop members 100 and 102, respectively, rigidly attached to the bottom sides thereof. The stop members 100 and 102 are positioned to abut each other when the framework 26 is unfolded or extended so that the parts 80 and 82 of the framework 26 are prevented from being folded downwardly.

As best shown in FIGS. 3, 4 and 6, the lower ends of the arm members 72 and 74 are connected to the angles 88 and 90, respectively, by pivotable ball and joint fittings 104 and 106, respectively. The lower end of the shaft 38 of the power cylinder 36 is connected to a U-shaped connector 108 which is in turn pivotally connected to the upper end of a lever 110 by a bolt or pin 112. The lower end of the lever 110 is rigidly attached to the shaft 94 at a position thereon coinciding with the center of the circular shaped framework 26. As shown in the drawings, the arm members 72 and 74 are connected to the angles 88 and 90 by the connectors 104 and 106 at points which are offset from the center of the framework 26. Further, the connectors 104 and 106 lie on a line substantially transverse to the shaft 94 and the diameter along which the framework 26 unfolds. Thus, as will be described further, when the shaft 38 of the pneumatic cylinder 36 moves upwardly and downwardly, the upper end of the lever 110 also moves upwardly and downwardly causing the framework 26 to move between a folded position whereby the shaft 94 thereof is positioned vertically and an unfolded or extended position whereby the framework 26 and the shaft 94 thereof are positioned horizontally. As will be understood by those skilled in the art, a variety of mechanisms other than the pneumatic cylinder 36, the pivotal arm members 72 and 74 and the lever 110 can be utilized for remotely moving the framework 26 between the folded and unfolded positions described above, and consequently, this invention is not limited to the specific mechanism described.

Referring still to FIGS. 3 and 4, the semicircular bars 84 and 86 of the parts 80 and 82 of the framework 26 include inflatable tubes 114 and 116, respectively, attached thereto. The tubes 114 and 116 are of lengths such that when the framework 26 is extended, they form a continuous circle. The ends of the tubes 114 and 116 are closed by fittings 118 and 120 (FIG. 4) which are sealingly held in place by conventional hose clamps 122 and 124. As will be understood, two of the fittings 118 and hose clamps 122 are utilized with the inflatable tube 114 and two of the fittings 120 and hose clamps 124 are utilized with the tube 116. Disposed within each of the inflatable tubes 114 and 116 are lengths of linear shaped charge 126 and 128, respectively, which are curved to conform to the semicircular shape of the bars 84 and 86.

Figure 7:
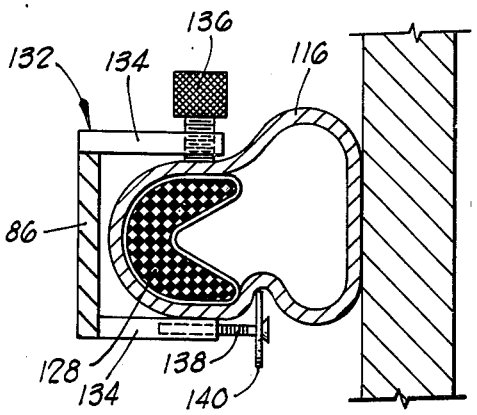
FIG. 7 is a cross-sectional view taken along line 7—7 of FIG. 4.

A plurality of connectors, generally designated by the numeral 130, are attached to the bar 84 in spaced relationship along the length thereof for holding the inflatable tube 114 and shaped charge 126 in a position adjacent the bar 84. Identical connectors 132 are attached to the bar 86 for holding the inflatable tube 116 and shaped charge 128 thereto. Referring specifically to FIG. 7, one of the connectors 132 attached to the bar 86 is illustrated in detail as is the inflatable tube 116 and shaped charge 128 held thereby. Each of the connectors 132 includes a pair of outwardly extending vertically aligned lugs 134 attached to the upper and lower ends of the bar 86. The upper lug 134 includes a vertically positioned threaded opening positioned adjacent the outer end thereof within which a threaded thumb screw 136 is positioned. The lower lug 134 includes a horizontally positioned threaded bore disposed in the end thereof within which a threaded bolt or screw 138 is positioned having a washer 140 positioned thereon. The lower portions of the tube 116 and shaped charge 128 are retained by the bolt 138 and washer 140 and the upper portions are retained by the thumb screw 136 which is tightened against the tube 116 and shaped charge 128. The connectors 132 attached to the bar 86 are identical to the connectors 130 attached to the bar 84.

As shown best in FIG. 4, one of the fittings 118 sealing the ends of the inflatable tube 114 includes an air inlet connection 142 attached thereto, and a hose 144 is connected between the connection 142 and a T-shaped fitting 146 attached to the angle 88. A second hose 148 is connected to the fitting 146 and to an air inlet (not shown) attached to one of the fittings 120 sealing the ends of the inflatable tube 116. A third hose 150 is connected to the fitting 146 which is passed through one of the tubular members 34 of the frame 24 to the upper end of the apparatus 10. The hose 150 as well as the hoses 4 and 46 attached to the pneumatic cylinder 36 are at tached to the cable 50 and connect the apparatus 10 t a source of pressurized air and appropriate conventiona controls located near the upper end of the tubular mem ber to be severed.

The shaped charges 126 and 128 are positioned s that upon detonation the explosive jets formed trave radially outwardly from the peripheral portions of th framework 26. That is, the shaped charges 126 and 12 are positioned so that the internal portions of the V shape face outwardly towards the walls of the tubula member to be severed when the framework 26 is ex tended. Appropriate electrically operated detonator 152 and 154 are attached over openings in the bars 8 and 86 of the framework 26 so that when the detonator 152 and 154 are electrically activated, the resultan explosions are communicated with the shaped charge 126 and 128 causing the detonation thereof. Appropri ate electrical wires 156 and 158 are attached to th detonators 152 and 154, respectively, and are spliced t a third set of wires 160 which are passed through one o the tubular members 34 of the frame 24 to above th apparatus 10. As will be understood, the wires 160 ar connected to a suitable source of electric power an switch closure means located adjacent the top end o the tubular member to be severed.

OPERATION

Figure 10:
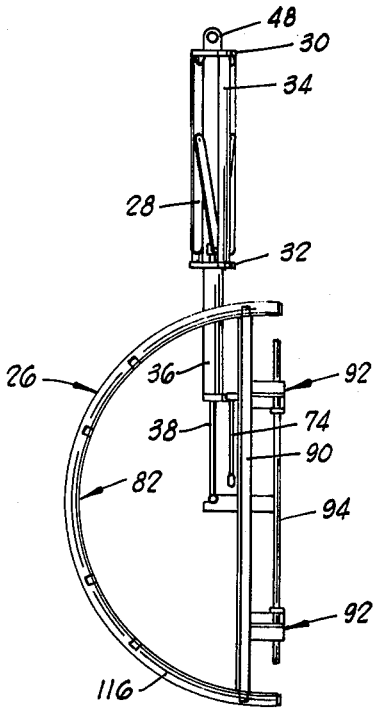
FIG. 10 is a side view of the apparatus of the present invention in the non-extended position.
Figure 11:
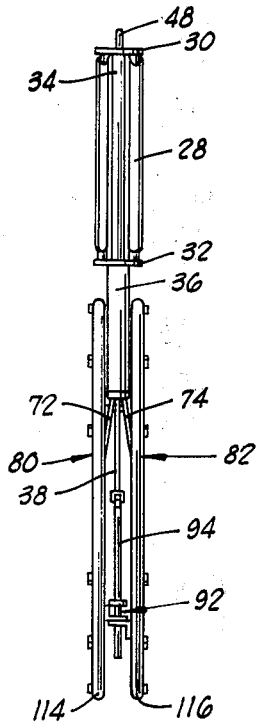
FIG. 11 is an end view of the apparatus of FIG. 10.

Referring now specifically to FIGS. 1, 2 and 10–13 in operation of the apparatus 10, air pressure is supplie to the top end of the pneumatic cylinder 36 by way o the hose 44 while venting the lower end thereof by wa of the hose 46 which moves the shaft 38 downwardly t a position whereby the centering members 28 are folde downwardly and the circular framework 26 is folde upwardly and rotated so that the shaft 94 thereof i positioned vertically as shown in FIGS. 1, 10 and 11. I this configuration, the apparatus 10 is lowered withi the interior of the length of pipe 12 through the con strictions therein formed by the connectors 18 to th location where it is desired to sever the length of pip 12.

Figure 12:
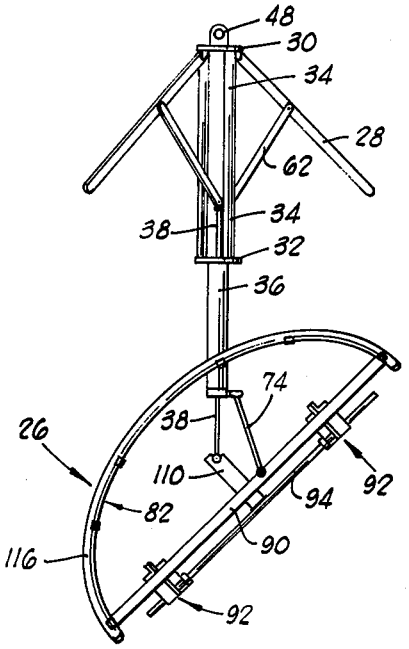
FIG. 12 is a side view of the apparatus of the present invention similar to FIG. 10, but illustrating the apparatus in a partially extended position.
Figure 13:
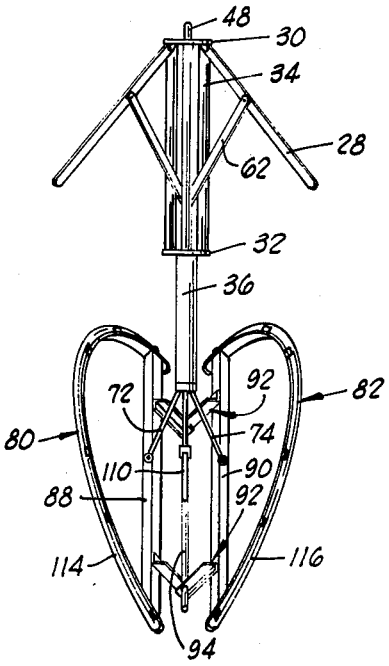
FIG. 13 is an end view of the apparatus illustrated in FIG. 12.

Air pressure is next applied to the bottom of the cylin der 36 by way of the hose 46 while venting the to thereof by way of the hose 44 which moves the shaft 3 upwardly. As the shaft 38 moves upwardly, the leve arms 62 pivotally attached to the upper end of the sha 38 and to the centering members 28, are moved up wardly which in turn moves the centering members 2 from the folded position toward the extended positio as shown in FIGS. 12 and 13. Simultaneously, the lowe end of the shaft 38 is moved upwardly which moves th lever 110 attached to the shaft 94 of the framework 2 upwardly. Because the arm members 72 and 74 are c set length and are pivotally attached at their upper end to the cylinder 36 and at the lower ends to the angles 8 and 90, as the lever 110 attached to the shaft 94 move upwardly, it pulls the shaft 94 upwardly causing the arr members 72 and 74 to exert a downward force on th angles 88 and 90. This upward movement of the shaft 9 and downward force on the angles 88 and 90 cause th parts 80 and 82 of the framework 26 to unfold. Simult neously, because the lever 110 is attached to the shaft 9 at a point coinciding with the center of the framewor 26, and the arm members 72 and 74 are attached to th angles 88 and 90 on a line transverse to the axis of th shaft 94 which is offset a distance from the point attachment of the lever 110, the entire framework 26 is rotated causing the shaft 94 to move from a vertical position towards a horizontal position as shown in FIGS. 12 and 13.

When the shaft 38 of the pneumatic cylinder 36 has moved upwardly through the full extent of its travel, the centering members 28 are moved to a position whereby they are extended outwardly in a horizontal plane with the ends thereof adjacent the walls of the length of pipe 12, and the framework 26 is fully rotated and extended so that it lies in a horizontal plane with the peripheral portions thereof, the inflatable tubes and the shaped charges attached thereto positioned adjacent the walls of the length of pipe 12 as shown in FIG. 2.

After the apparatus 10 has been positioned at the desired location within the length of pipe 12 and extended, air pressure is supplied by way of the hose 150 to the inflatable tubes 114 and 116 so that the tubes are inflated. The inflation of the tubes 114 and 116 moves the outside portions of the tubes 114 and 116 into contact with the walls of the length of pipe 12 centering the framework 26 therebetween. More importantly, the inflation of the tubes 114 and 116 provides an air space between the shaped charges 126 and 128 and the walls of the length of pipe 12 and insures that the required stand-off is obtained even though the length of pipe 12 may be filled with liquids at the location of the apparatus 10.

Once the apparatus 10 has been positioned at the desired location within the length of pipe 12, the centering members 28 and framework 26 extended therein and the tubes 114 and 116 inflated, the shaped charges 126 and 128 are detonated by supplying electrical power to the detonators 152 and 154 resulting in the severing of the length of pipe 12 and allowing the portion of the length of pipe 12 above the point of sever as well as the connectors 18 contained therein to be recovered.

What is claimed is:

1. A method of severing a tubular member comprising the steps of:

placing a tool within the interior of said tubular member at the point where it is desired to sever said member, said tool including a remotely extendible framework formed of a pair of hinged semicircular parts which when extended move from a folded vertical position to an unfolded horizontal position having one or more remotely detonatable shaped charges attached thereto, said tool and framework being of a size such that when said framework is not extended, said tool readily passes through said tubular member and when extended, said framework is positioned transversely to the axis of said member and said shaped charges are positioned adjacent the interior walls of said member;

extending said framework after said tool has been placed within said member so that said shaped charges are positioned adjacent the interior walls of said member at said point where it is desired to sever said member; and detonating said charges thereby severing said member.

2. The method of claim 1 which is further characterized to include the step of spacing said shaped charges from the interior walls of said member to provide the required stand-off prior to detonating said shaped charges.

3. The method of claim 2 wherein the step of spacing said shaped charges from the interior walls of said member comprises:

said framework including one or more remotely inflatable tubes attached thereto surrounding said shaped charges and positioned so that when said framework is extended and said tubes are inflated, said framework is centered within said tubular member and the required stand-off between said shaped charges and the interior walls of said member is provided; and inflating said tubes after said framework has been extended within said tubular member and prior to detonating said shaped charges.

4. A method of severing a tubular member having at least one internal constriction therein at a point below or beyond said constriction comprising the steps of:

placing a tool within the interior of said tubular member at the point below or beyond said constriction where it is desired to sever said member, said tool including a remotely extendible framework formed of a pair of hinged semicircular parts which when extended move from a folded vertical position to an unfolded horizontal position having one or more remotely detonatable shaped charges attached thereto, said tool and framework being of a size such that when said framework is not extended, said tool passes through said constriction and when extended, said framework is positioned transversely to the axis of said member and said shaped charges are positioned in a contiguous pattern adjacent the interior walls of said member;

extending said framework after said tool has been placed within said member and passed through said constriction so that said shaped charges are positioned adjacent the interior walls of said member at said point where it is desired to sever said member; and detonating said charges thereby severing said member.

5. The method of claim 4 which is further characterized to include the step of spacing said shaped charges from the interior walls of said member to provide the required stand-off prior to detonating said shaped charges.

6. The method of claim 5 wherein the step of spacing said shaped charges from the interior walls of said member comprises:

said framework including one or more remotely inflatable tubes attached thereto surroudind said shaped charges and positioned so that when said framework is extended and said tubes are inflated, said framework is centered within said tubular member and the required stand-off between said shaped charges and the interior walls of said tubular member is provided; and inflating said tubes after said framework has been extended within said tubular member and prior to detonating said shaped charges.

7. A method of severing a length of vertically positioned pipe formed of a plurality of pipe sections connected together by connectors which form internal constrictions within said length of pipe comprising the steps of:

lowering a tool within the interior of said length of pipe to the point therein where it is desired to sever said pipe, said tool including a remotely extendible framework formed of a pair of hinged semicircular parts which when extended move from a folded vertical position to an unfolded horizontal position having one or more remotely detonatable shaped charges attached thereto, said tool and framework being of a size such that when said framework is not extended, said tool passes through said constrictions formed by said connectors and when extended, said framework is positioned transversely to the axis of said length of pipe and said shaped charges are positioned in a contiguous circle adjacent the interior walls of said pipe;

extending said framework after said tool has been lowered within said length of pipe so that said shaped charges are positioned adjacent the interior walls of said pipe at the location where it is desired to sever said pipe;

centering said framework within said pipe so that the required stand-off is provided between said shaped charges and said internal walls of said pipe; and detonating said shaped charges to thereby sever said pipe.

8. The method of claim 7 wherein each of said semicircular parts of said framework have an elongated semicircular shaped charge attached to the peripheral portions thereof.

9. The method of claim 8 wherein the step of centering the framework within said pipe comprises:

each of said semicircular parts of said framework including a remotely inflatable tube attached thereto and surrounding said shaped charge so that when said framework is extended and said tubes are inflated, said framework is centered within said pipe and the required stand-off between said shaped charges and the interior walls of said pipe is provided; and inflating said tubes after said framework has been extended within said pipe and prior to detonating said shaped charges.

10. Apparatus for severing a tubular member at a point between the ends of said tubular member comprising:

a frame adapted to be placed within the interior of said tubular member;

a foldable framework pivotally attached to said frame;

remotely operable means for moving said framework from a folded position whereby the line of fold of said framework is positioned parallel to the axis of said frame to an unfolded position whereby said line of fold is positioned transversely to the axis of said frame attached to said frame and to said framework; and remotely detonatable shaped charge means for severing the walls of said tubular member attached to the peripheral portions of said framework.

11. The apparatus of claim 10 wherein said shaped charge means are comprised of a pair of elongated curved shaped charges attached to the peripheral portions of said framework.

12. The apparatus of claim 11 which is further characterized to include a pair of remotely inflatable tubes attached to the peripheral portions of said framework and surrounding said shaped charges attached thereto so that when said tubes are inflated, said apparatus is centered within said tubular member and the required stand-off between the internal walls of said tubular member and said shaped charges is provided.

13. Apparatus for severing a tubular member at a point between the ends of said tubular member comprising:

a frame adapted to be placed within the interior of said tubular member;

a pair of arm members having the upper ends thereof pivotally attached to one end of said frame;

a foldable framework pivotally attached to the other ends of said arm members at connections positioned on opposite sides of the line of fold of said framework;

a lever attached to said framework at a point coinciding with the line of fold of said framework but offset from said arm member connections;

remotely operable means for moving said lever attached to said lever and to said frame to that said framework can be moved from a folded position whereby said line of fold is positioned parallel to the axis of said frame to an unfolded position whereby said line of fold is positioned transversely to the axis of said frame; and remotely detonatable shaped charge means for severing the walls of said tubular member attached to the peripheral portions of said framework.

14. The apparatus of claim 13 wherein said shaped charge means are comprised of a pair of elongated curved shaped charges attached to the peripheral portions of said framework.

15. The apparatus of claim 14 which is further characterized to include a pair of remotely inflatable tubes attached to the peripheral portions of said framework and surrounding said shaped charges attached thereto so that when said tubes are inflated, said apparatus is centered within said tubular member and the required stand-off between the internal walls of said tubular member and said shaped charges is provided.

16. The apparatus of claim 15 wherein said remotely operable means for moving said lever is a vertically positioned pneumatically operated power cylinder having a downwardly extending shaft attached to a movable piston disposed within said cylinder, the lower end of said shaft being pivotally attached to said lever.

17. Apparatus for severing a length of vertically positioned pipe formed of two or more pipe sections connected together by connectors which form internal constrictions within said length of pipe which comprises:

a frame adapted to be attached to a cable at the upper end thereof and lowered through the interior of said length of pipe;

a pair of arm members having the upper ends thereof pivotally attached to the lower end of said frame;

a circular framework comprised of a pair of hinged-together semicircular parts whereby said framework folds along a diameter thereof pivotally attached to the lower ends of said arm members at connections positioned on opposite sides of said diameter, said connections lying on a line transverse to said diameter and offset from the center of said framework;

a lever attached to said framework at a point coinciding with the center thereof;

remotely operable means for moving said lever attached thereto and to said frame so that said framework can be moved from a folded vertical position whereby said diameter along which said framework folds is positioned vertically and said framework passes through said internal constrictions formed by said connectors in said length of pipe to a horizontal unfolded position whereby the peripheral portions of said framework are positioned adjacent the walls of said pipe; and remotely detonatable shaped charge means for severing the walls of said pipe attached to the peripheral portions of said framework.

18. The apparatus of claim 17 wherein said shaped charge means are comprised of a pair of elongated curved shaped charges attached to the peripheral portions of said semicircular parts of said framework.

19. The apparatus of claim 18 which is further characterized to include a pair of remotely inflatable tubes attached to said framework and surrounding said shaped charges attached thereto so that when said tubes are inflated, said apparatus is centered within said pipe and the required stand-off between the internal walls of said pipe and said shaped charges is provided.

20. The apparatus of claim 19 wherein said means for remotely moving said lever is a vertically positioned pneumatically operated power cylinder attached to said frame having a downwardly extending shaft attached to a movable piston disposed within said cylinder, the lower end of said shaft being pivotally attached to said lever.

* * * * *